US007071873B2

(12) United States Patent
Tomasic et al.

(10) Patent No.: US 7,071,873 B2
(45) Date of Patent: Jul. 4, 2006

(54) T/R MODULE FOR SATELLITE TT AND C GROUND LINK

(75) Inventors: Boris Tomasic, Harvard, MA (US); Sarjit S. Bharj, Mercerville, NJ (US); Paul J. Oleski, Holland Patent, NY (US); John P. Turtle, Wellesley, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 11/124,511

(22) Filed: Apr. 29, 2005

(65) Prior Publication Data

US 2005/0242992 A1 Nov. 3, 2005

Related U.S. Application Data

(60) Provisional application No. 60/566,788, filed on Apr. 30, 2004, provisional application No. 60/566,768, filed on Apr. 30, 2004, provisional application No. 60/566,770, filed on Apr. 30, 2004.

(51) Int. Cl.
*H01Q 3/22* (2006.01)
*H01Q 3/24* (2006.01)

(52) U.S. Cl. ..... 342/372; 342/374

(58) Field of Classification Search ..... 342/368, 342/372, 373, 374; 455/277.1, 277.2
See application file for complete search history.

(56) References Cited

U.S. PATENT DOCUMENTS 4,914,441 A * 4/1990 Brookner ..... 342/161
5,923,289 A * 7/1999 Buer et al. ..... 342/373
6,388,631 B1 * 5/2002 Livingston et al. ..... 343/767
6,606,055 B1 * 8/2003 Halsema et al. ..... 342/368

* cited by examiner

*Primary Examiner*—Dao L. Phan
(74) *Attorney, Agent, or Firm*—Joseph A. Mancini

(57) ABSTRACT

Transmit/Receive (T/R) module that provides multiple simultaneous ground to satellite links with rapid pointing and acquisition. The (T/R) module incorporates independent gain and phase control. Left-hand or right-hand circular polarization can be supplied to dual feed antennas. Present invention allows each antenna to be independently polarized. Low-cost componentry is utilized throughout. On-board control of the (T/R) module is obtained using a complex programmable logic device (CPLD) and a micro controller. CPLD provided separate control of four phase shifters, attenuators, channel polarization as well as transmitter on/off control. Telemetry is provided through built-in test (BIT) routine.

17 Claims, 7 Drawing Sheets

T/R MODULE FOR SATELLITE TT AND C GROUND LINK

PRIORITY CLAIM UNDER 35 U.S.C. §119(e)

This patent application claims the priority benefit of the filing date of provisional application Ser. Nos. 60/566,788, 60/566,768 and 60/566,770, all having been filed in the United States Patent and Trademark Office on Apr. 30, 2004 and now incorporated by reference herein.

STATEMENT OF GOVERNMENT INTEREST

The invention described herein may be manufactured and used by or for the Government for governmental purposes without the payment of any royalty thereon.

BACKGROUND OF THE INVENTION

This invention relates generally to the design of a Transmit and Receive (TR) module, and, more specifically, to such Transmit and Receive modules suitable for a Phase Array Antenna (PAA) which could provide multiple simultaneous ground to satellite links with pointing and acquisition taking seconds. This invention also relates to the field of digital control design where a digital circuit is used to interface with the Antenna Control Computer to control the Transmit and Receive module.

Satellites require timely tracking, telemetry, and command (TT&C) for payload operation. The ground antenna is one of the key elements that enables satellite control and payload operations. To support the operation of a large number of satellites at various orbits, operators need a network of antennas distributed around the globe, such as the Air Force Satellite Control Network (AFSCN), to contact satellites at a predetermined time and location. Currently, they use large mechanically steered parabolic dishes to provide hemispherical coverage and simultaneous transmit (Tx) and receive (Rx) capabilities in support of Department of Defense (DoD) satellite operations (SATOPS). Network designers used reflector antennas because of relatively low acquisition cost. The current reflector antennas used to support satellite operations are approximately 10 m in diameter and are susceptible to single point failure and long downtime for repair and maintenance. The antenna can only link to one satellite at a time and must handle multiple satellite contacts serially. Because of the mechanical movement and heavy weight of the reflector antenna, operators cannot quickly schedule consecutive satellite contacts. The relatively long preparation and link time of reflector antennas produces a scheduled gap time of 30 minutes or more between two satellites. Because of these factors, the efficiency of reflector antenna operation is low in terms of throughput and turnaround time. The mechanical nature of the antenna also limits its flexibility to support new SATOPS requirements and operational concepts. In addition, the high operational and maintenance cost of a large reflector antenna contributes to its high life-cycle cost despite its lower initial cost. Other limitations include: cable wrap and keyhole effect. In addition, separate antennas are required for multiple satellite contacts. Current AFSCN resources are operating at or near saturation.

It is clearly desirable for the current satellite operations to have a more efficient and flexible antenna system. To date, phased array antennas have not been used for satellite TT&C operations primarily because of their high acquisition cost in comparison to technically inferior, but cheaper conventional reflector antennas. However, due to the maturation of S-band component technology provided by the cell phone industry, mass production of affordable electronically steered array (ESA) antennas is feasible. The electronically scanned phase array antenna (PAA) can offer superior performance, operability, adaptability, and maintainability for satellite operation.

Low cost component design and implementation issues are critical in developing a practical phased array antenna. Because the Transmit and Receive modules usually make up 40–50% of the PAA cost, it is very critical to minimize the T/R module cost and, consequently, the antenna cost.

Affordable phase antenna arrays operating at microwave frequencies are envisioned to consist of Transmit and Receive modules that employ microwave integrated circuits located at each radiating element of the aperture. The antenna system consists of separate receiver and transmit aperture capable of rapid beam motion. The transmitter antenna should be capable of high radiation power levels and the receiver antennas must achieve high G/T ratios. Beam agility and high-radiated power levels in association with the close spacing between the radiators drive the antenna design. The requirement for fast beam switching will require digital control circuits to calculate phase shift settings. A high RF radiated power level developed from closely spaced RF amplifiers generates very large heat densities. This forces the transmit antenna to increase in area to where beam pointing accuracy limits the array size. The great number of elements in the array emphasizes the need to develop a practical method of distributing control signals throughout the array. A Geodesic Spherical phase array antenna is considered for Air Force Satellite Communication network. Implicit in the system function array is the need to operate the array in full duplex operation. Additionally the array should be capable of controlling fundamental radiation characteristics such as bean width, beam size, side lobe levels and radiated power, in order to realize different antenna characteristics required by the various satellites. The array aperture consists of a large number of radiating elements that are spaced approximately half a wavelength at the upper end of the operational frequency band. The frequency response and excitation of each element in the aperture can be independently controlled. The aperture can be fully or partially utilized either to direct energy over a large volume or intentionally direct in a certain direction. Additionally, radar and communications require both transmission and reception of energy where as end system multicast (ESM) and Electronic Countermeasure (ECM) systems require only reception of energy. The capability of the array to provide transmit and receive functions simultaneous and to rapidly alter the set of configurations is possible due to active element digital control circuit. The active control circuits allow the Phase Array Radar to control their radiation characteristics. The aperture can be uniformly illuminated to achieve maximum gain or tapered illuminated to achieve low side lobes or shaped beam. The combination of the variable attenuator and phase shifter permits the array illumination to be modified and the antenna beam to be scanned in any direction. The filter specifies the portion of the aperture used by a particular system. The phase shifter, the variable attenuator and the amplifier are components that have been developed in MMIC, (microwave monolithic integrated circuit technology,) in the last decade.

Solutions are required to meet the prior art's need for a high degree of isolation between transmit and receive channels while maintaining the affordability associated with low-cost ceramic filters and traditional filters, low cost MMIC based power amplifiers for transmit channels and low-cost phase shifters.

Also needed are solutions, now lacking in the prior art, for interfacing a T/R module interface with a beam former, hot condition operation, polarization diversity, dual transmit and receive channels, low cost with justification, high isolation between transmit and receive channels, digital control on board, ruggedness and reliability.

OBJECTS AND SUMMARY OF THE INVENTION

It is therefore an object of the present invention to provide an apparatus that overcomes the dependence of Air Force satellite control network (AFSCN) on mechanically steered parabolic antennas that provide Transmit and Receive (TR) capabilities in support of satellite operations (SATOPS).

It is a further object of the present invention is to provide an apparatus for on-board control of Transmit and Receive modules using field programmable gate array (FPGA) or a complex programmable logic device (CPLD) and a micro controller.

It is still a further object of the present invention is to provide an apparatus for polarization of Transmit and Receive modules. This requires a means of addressing two dual feed antennas as left-hand or right-hand circular polarization. Having a beam polarization is required for the operation of the T/R module in a phase array antenna.

Briefly stated, the present invention achieves these and other objects through design of a Transmit and Receive module that can provide two separate Transmit (Tx) and two Receive (Rx) links to a satellite. In addition, beam switching and on board digital control have been implemented where each of the Tx and Rx channels provide four-bit phase shift and five-bit amplitude control. The T/R module is configured to receive synchronous serial signals that are used to control T/R Module settings (e.g., set amplitude and phase values) and to instruct a T/R Module to perform a built-in test (BIT). Built-in test circuit monitors the module temperature and status of the RF devices. The polarization switching is incorporated in the module by using a RF switch, power combiner and a 90-deg hybrid. Both left hand and right hand circular polarization is achieved in the transmit and receive section of the module.

Each Transmit and Receive module consists of a separate RF board and a DC control unit that interfaces the RF board and controls the MMIC's on the RF board. The module consists of a total of six RF I/O ports, two transmit inputs, two receive outputs and two antenna ports. The transmitted signal is input at one of the transmit input ports and undergoes transformation (phase or magnitude) before being transmitting through a high rejection low pass ceramic filter reaching the output antenna ports. For the downlink (receiver), the input signal is fed to a high rejection band pass ceramic filter using Antenna1/Antenna2 port and undergoes transformation (phase or magnitude) before passing through one of the receive outputs. The input signal in the Transmit and Receive module is programmatically transformed by controlling the MMIC chips on the RF board through a digital control circuitry. The Transmit and Receive module in turn communicates with an antenna control computer that sends data to the T/R Modules to control T/R Module settings (e.g., set amplitude and phase values) and to instruct a T/R Module to perform a built-in test (BIT). A low power complex programmable logic device (CPLD) on the digital board receives the synchronous signals from the Antenna control computer and depending on the received command, latches the data to one of the four RF channels. A micro controller with analog to digital converter peripherals is used to sense the module temperature and transmit and receive currents and send this data back to the Antenna control computer.

The power supplies to the Transmit and Receive module are routed through power switches which have short circuit and thermal protection features and this allows hot plugging mechanism for the module. This is a nice feature to have in a Transmit and Receive module as this allows the replacement of a faulty module in the system without turning off the whole system. The module has an over current feature that allows the digital board of the module to turn off the power to the RF board if the module takes abnormal current.

Therefore, it is accurate to say that the present invention (1.) A multi-beam, Transmit and Receive module will greatly increase the number of satellite communication links to the Air Force Satellite Control Network, providing more reliable tracking, telemetry, and command; (2.) The module can accomplish multiple simultaneous operations, with pointing and acquisition taking seconds. As such, the present invention wherein a phase array antenna (PAA) using this Transmit and Receive module can offer superior performance, operability, adaptability, and maintainability for satellite operation.

According to an embodiment of the invention, apparatus for performing Transmit and Receive operation in a Transmit and Receive module comprise: a six pin RF front connecter to interface with the beam former, a digital phase shifter and a digital attenuator, power amplifiers and low noise amplifiers for the transmit and receive channels respectively, 3-dB power splitter, 90-deg hybrid, plurality of single pole double throw (SPDT) switches, plurality of five volts DC power switches and a temperature sensor.

According to a feature of the invention, a multi channel Transmit and Receive module that has simultaneous transmit and receive capabilities for the incident signal, this incident signal being programmatically controlled by the digital control board; and, a polarization circuit that can provide independent left hand and right hand circular polarization to the antenna ports.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
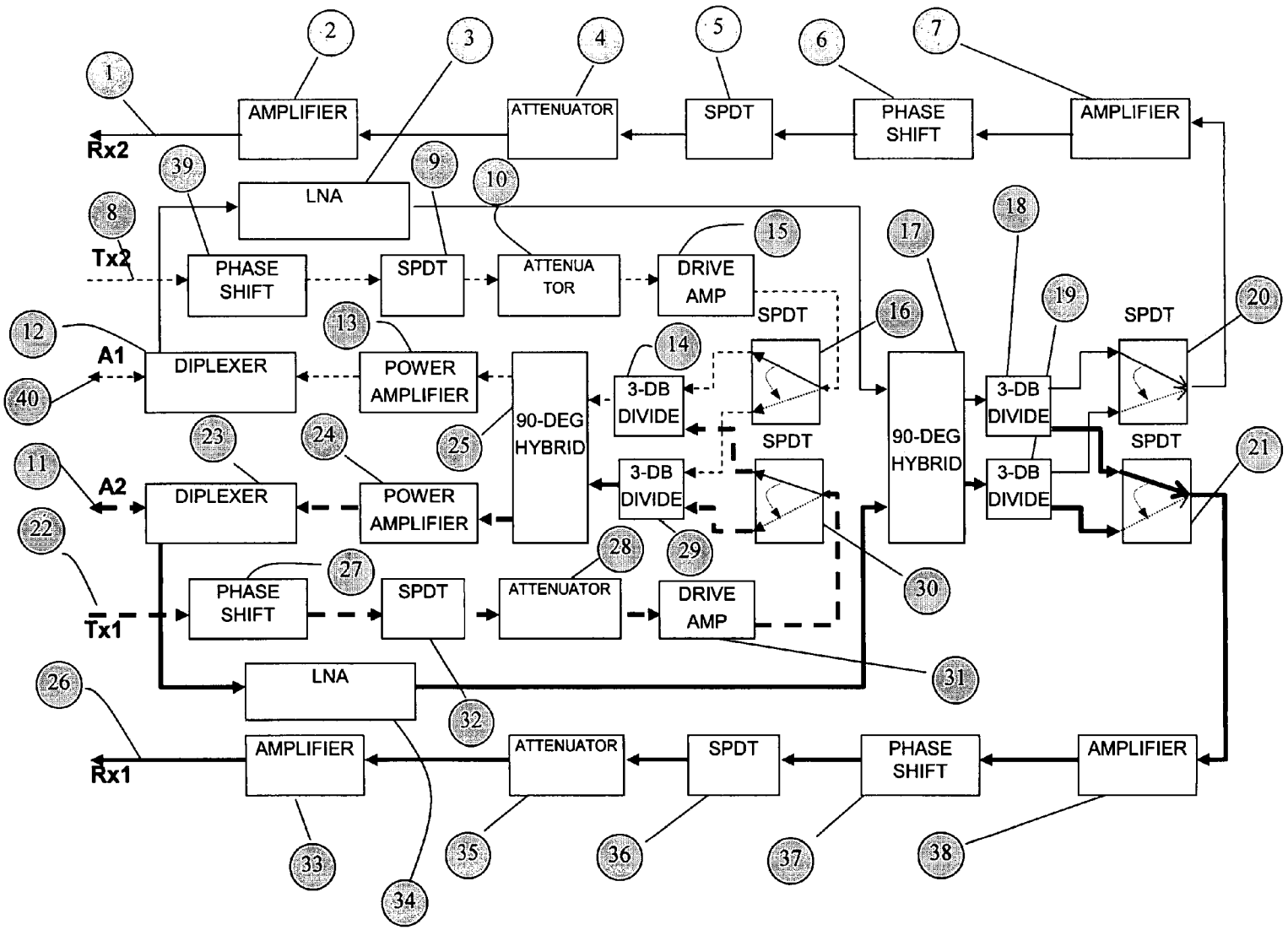
FIG. 1 is a graphical representation of block diagram of the RF section of the Transmit and Receive module.

Referring to FIG. 1, represented are the dual channel transmitter signal inputs 8, 22 and dual receiver signal outputs 1, 26 of the present invention. The transmit frequency of operation is 1.75–2.1 GHz. The receiver frequency of operation is 2.2–2.3 GHz. Each of the dual transmit paths consists of an input 8 or 22 and output to either of the two diplexed antenna ports 11 and 40. The transmitter signal passes through a four-bit phase shifter, 27 or 39 (ϕ shift of 22.5°, 45°, 90°, 180°), a SPDT switch, 9 or 32 that is used to open/close the RF path, a five-bit attenuator, 10 or 28 (attenuation levels of 1 dB, 2 dB, 4 dB, 8 dB, 16 dB), a pre amplifier, 15 or 31 and then through another absorptive type SPDT switch 16 or 30 before reaching the embedded power combiner 14 or 29. The absorptive SPDT switch is used to induce left hand circular polarization (LHCP) and right hand circular polarization (RHCP) in the signal. A 90-degree hybrid, 25 is used to provide quadrature phase in the input signal. The quadrature output of the hybrid is amplified using MMIC power amplifiers, 13 and 24 to a power output in excess of 30 dBm before transmitting through a high rejection low pass ceramic filter 12 and 23. The overall gain of the transmitter channel is 20 dB.

Again referring to FIG. 1, for each of the dual channels of the downlink receiver, an input signal is fed through one of the two antenna input ports 11, 40 into a high rejection band pass ceramic diplexer/filter 12, 23. The input signal passes through a low noise amplifier 3, 34, and then a 90-deg hybrid 17. Following this hybrid, the signal passes through an embedded power combiner 18 or 19, and then through another SPDT switch 20 or 21. The signal then passes through gain block amplifiers 7, 2 or 33, 38 and also the attenuator 35 or 4, the phase shifter 37 or 6 and the SPDT switch 5 or 36 before reaching the receiver ports 1 and 26. The total gain across the receiver band is 30 dB.

Figure 2:
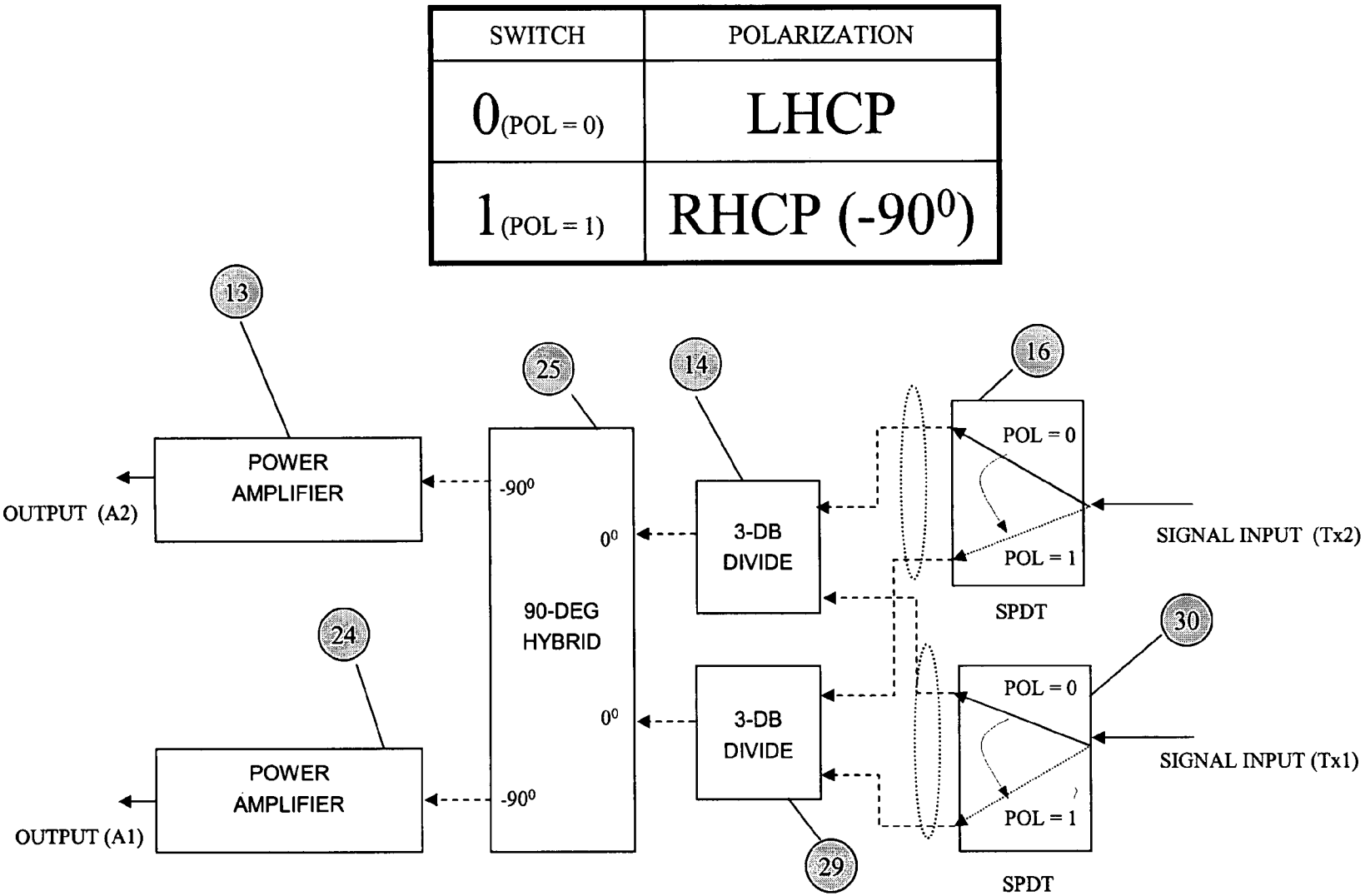
FIG. 2 is a graphical representation of the block diagram of the polarization circuit.

Referring to FIG. 2, which shows the polarization circuit in the transmitter channel. The input signal enters through one of the input channels and depending on the configuration of the polarization switch 16 or 30, passes through one of the power combiners 14 or 29. The output from the power combiner passes through the 90-deg hybrid 25 and appears in quadrature at the output of the hybrid. If the signal passes through the top power divider 14, then left hand circular polarization is achieved. If the signal passes through the bottom power combiner 29, then right hand circular polarization is obtained. Prior to entering the antenna ports A2 and A1, the signal is amplified at output power amplifiers 13 and 24, respectively. Thus the output signals at the output antenna ports are always in phase quadrature with respect to each other. This is a requirement of the phase array antenna.

Figure 3:
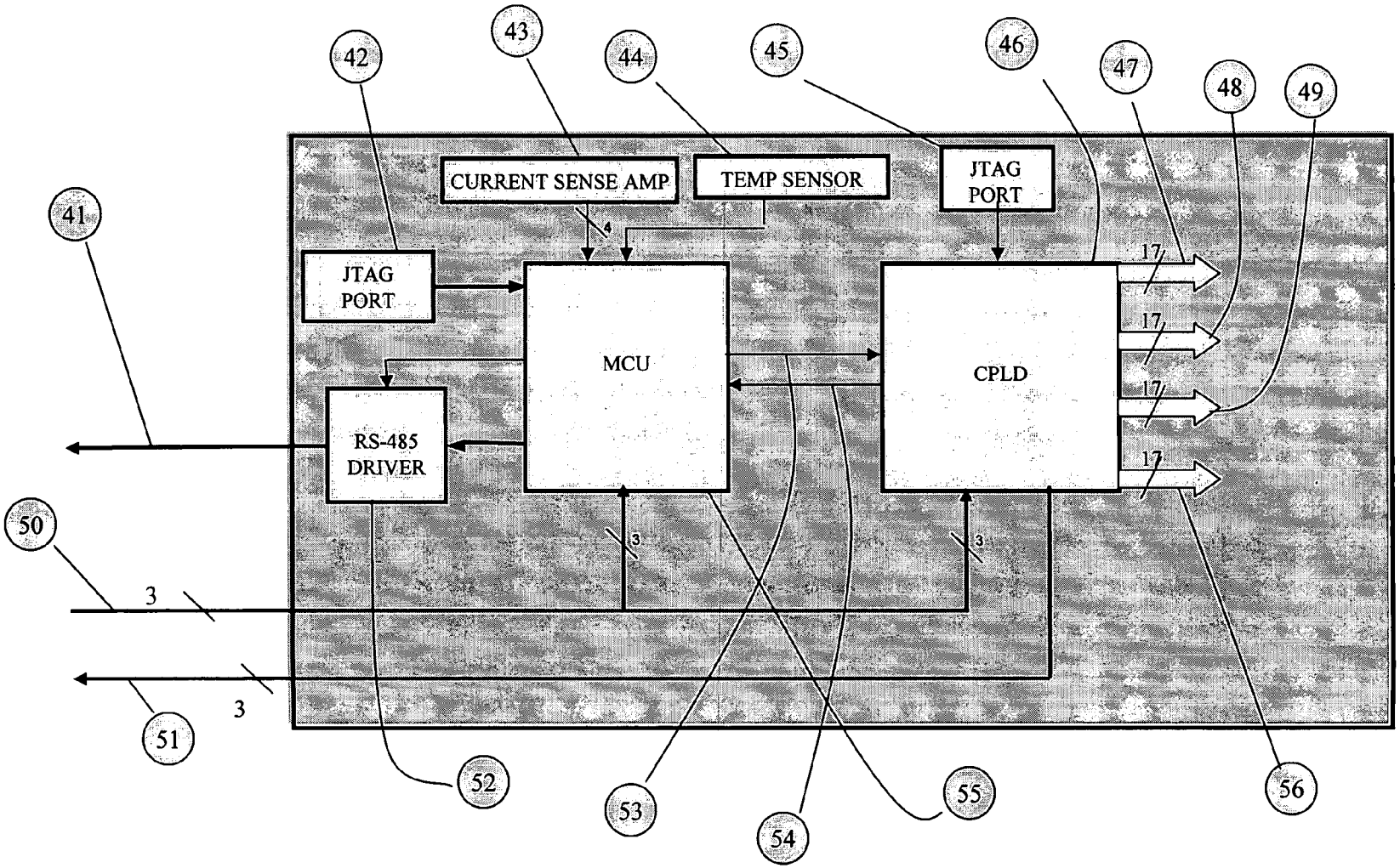
FIG. 3 is a graphical representation of simplified block diagram of the digital board.

Referring to FIG. 3, the DC board receives three synchronous serial signals, 50 (Clock, Data and enable) from the Antenna control computer through the 18-pin external interface connector located at the front side of the T/R Module. Synchronous serial signals 51 (Clock, Data and enable), and differential status signals 41 are sent back from the DC board to the front interface connector. The front interface connector also includes power lines to supply the required power to the T/R Module. These include the +5 low current and +5 high current signals.

Again referring to FIG. 3, the CPLD, 46 is the main component in the design of the DC board. This device is a 128-macro cell component with enough I/O's to supply the necessary control signals 47, 48, 49 and 56 to the different components of the RF board. This device is chosen from the cool runner II family of xilinx devices, which have the advantages of very low power consumption. The speed grade of the device is chosen to be 47 because speed is not a critical factor in the design and to keep the design cost minimal. 45 is the programming connector for the CPLD.

Once more referring to FIG. 3, the on board PIC micro controller 55 sends the module's status information (BIT) to the antenna control computer using the RS-485 multi drop output 52. An on board temperature sensor 44, LM20 is used to sense the temperature of the module. The current supplied to the transmitter and receiver amplifiers is measured using precise current sense resistors and amplified using a very stable current sense amplifier 43. This current sense amplifier 43 as a very stable internal gain of 50, which avoids the use of external gain setting resistors. The basic functionality of the PIC controller is to provide the analog to digital converters that are used to gather the status information from the module. The micro controller contains a programming connector 42. An over current signal 53 from the micro controller 55 to the CPLD 46 is activated if the micro controller senses abnormal RF current. The CPLD 46 goes to sleep at this point. A BIT activate signal 54 is toggled high if the CPLD 46 receives a command from the antenna control computer to sent the BIT information.

Figure 4:
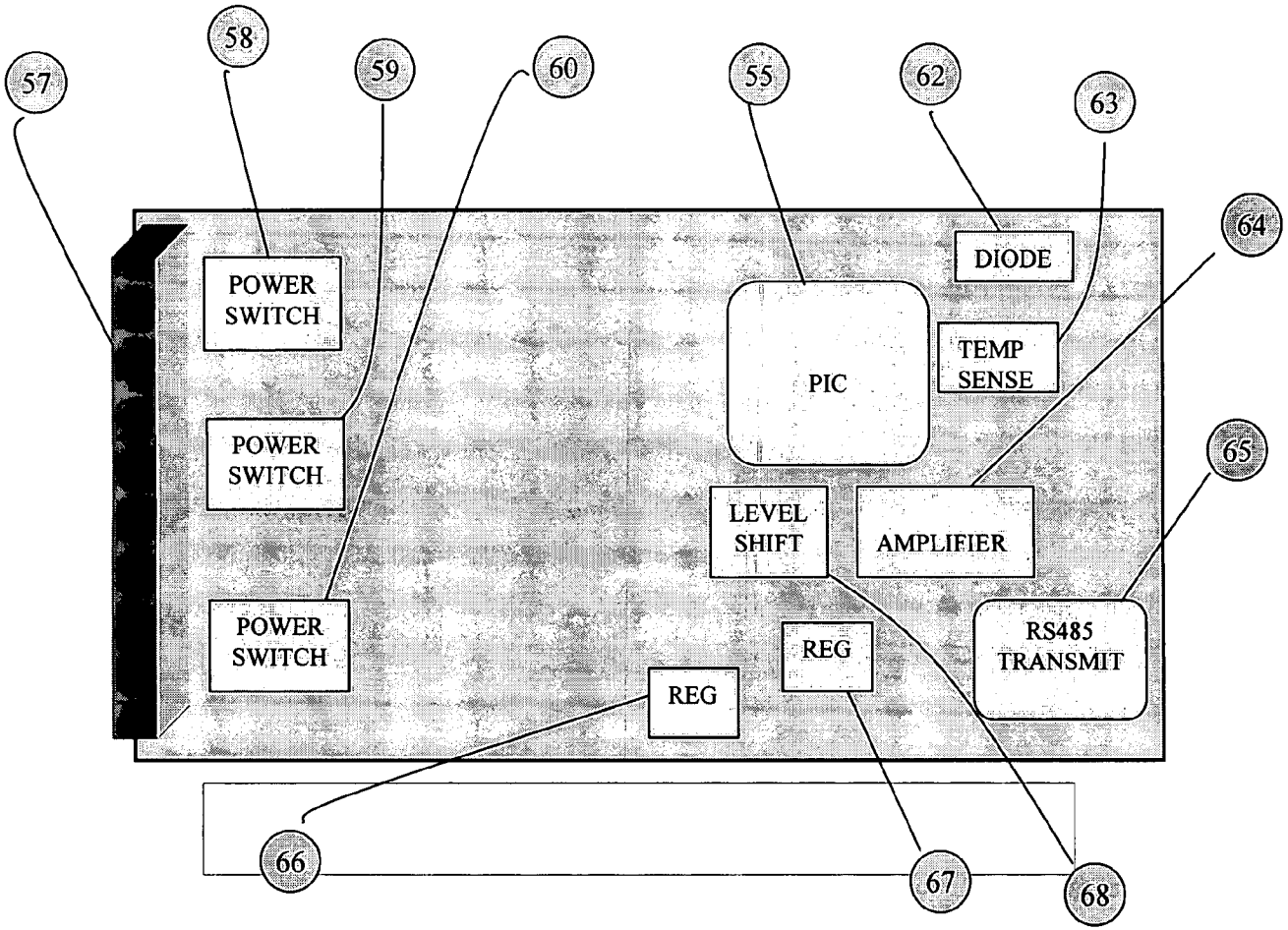
FIG. 4 is a graphical representation of the component placement of topside of digital board.
Figure 5:
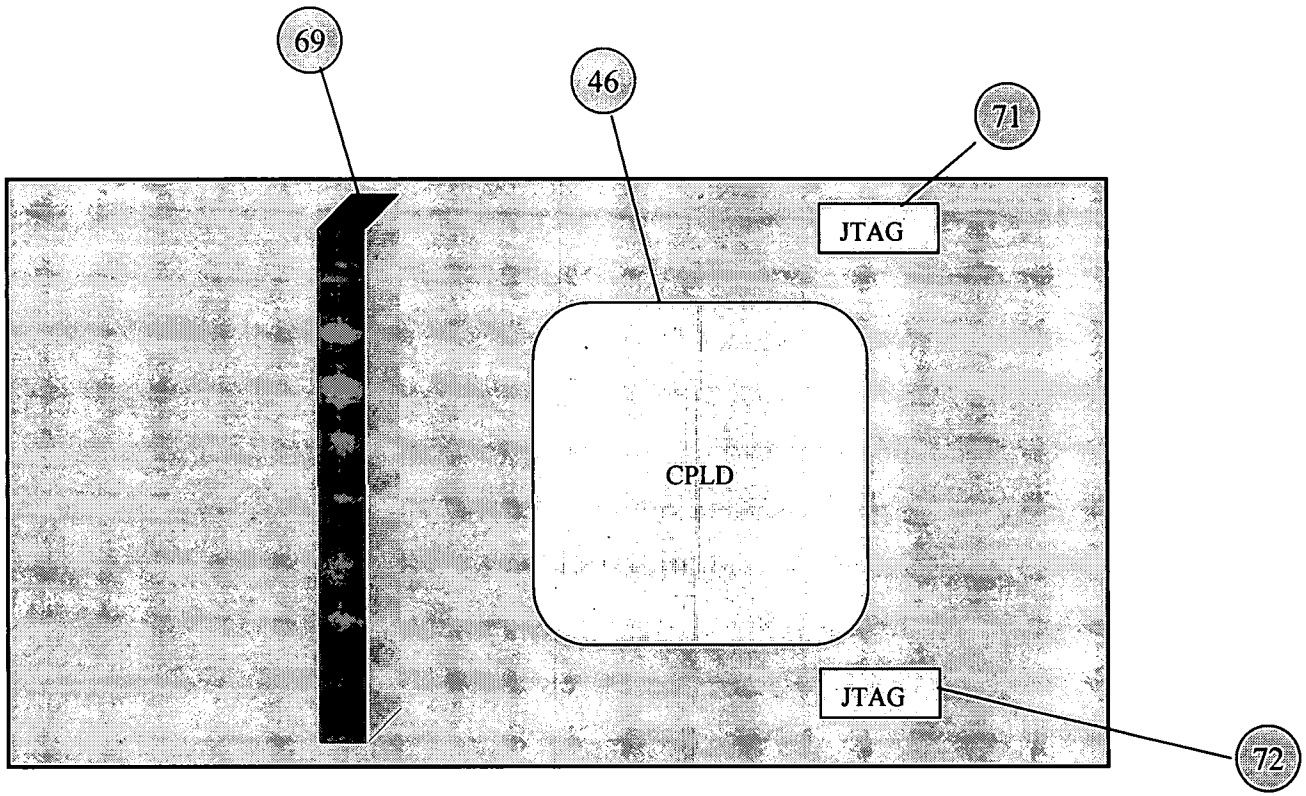
FIG. 5 is a graphical representation of the component placement of bottom side of digital board.

Referring simultaneously to FIG. 4 and FIG. 5, which shows the component placement on the top side and bottom side of the digital board, 57 and 69 represent 2×30 pins board connectors. These connectors are used to send the necessary control and power signals to the components on the RF side of the T/R Module. Connector 57 provides the control signals for the receiver and connector 69 provides the control signals to the transmitter. Components 58, 59 and 60 are power switches. The basic functionality of power switches 58, 59 and 60 is to provide the required voltages to different components of the T/R Module. All the external power supply signals feeding the T/R module pass through power switches 58, 59 and 60 which add additional isolation/shielding from external signal spikes and fluctuations. Switches 58, 59 and 60 have very good thermal and over current protection, which allows the modules to be hot-plugged into a powered system. Power switch 58 provides the supply current for transmitter beam 1 power amplifiers and power switch 59 provides the supply current for transmitter beam 2 power amplifiers. Power switch 60 is a dual power switch with two outputs, +5 volts for the components on the DC board and another +5 volts supplying power to the low noise amplifiers on the receiver side. Power switches 58 and 59 are capable of supplying a continuous current of up to 1 amp. Power switch 60 has capability of 250 mA continuous current in each output. These chips also provide an over current signal which goes low if the switch detects a current which is out of range of the supply current limit of the output. This signal is used by the micro controller 55 (see FIG. 3) to disable the power switches.

Again referring to FIG. 5, JTAG and ICD2 programming connectors 71 and 72 are used to program the on board cool runner CPLD 46 and micro controller 55 (see FIG. 3) respectively. These connectors stay on the board even after the devices are programmed. This should help ease the reconfiguration of the on board controllers should future modification be necessary.

Once more referring to FIG. 4, regulators 66 and 67 represent the on board regulators used to provide stable voltage to the components on the DC board. Regulator 66 is a very low drop out voltage regulator. This regulator is the only source of +5 volts for the DC board. Regulator 67 is a dual voltage regulator (1.8 V/3.3 V) that provides the necessary voltages to the CPLD 46. This regulator 67 in turn receives its input power from the low drop out voltage regulator 66.

Figure 7:
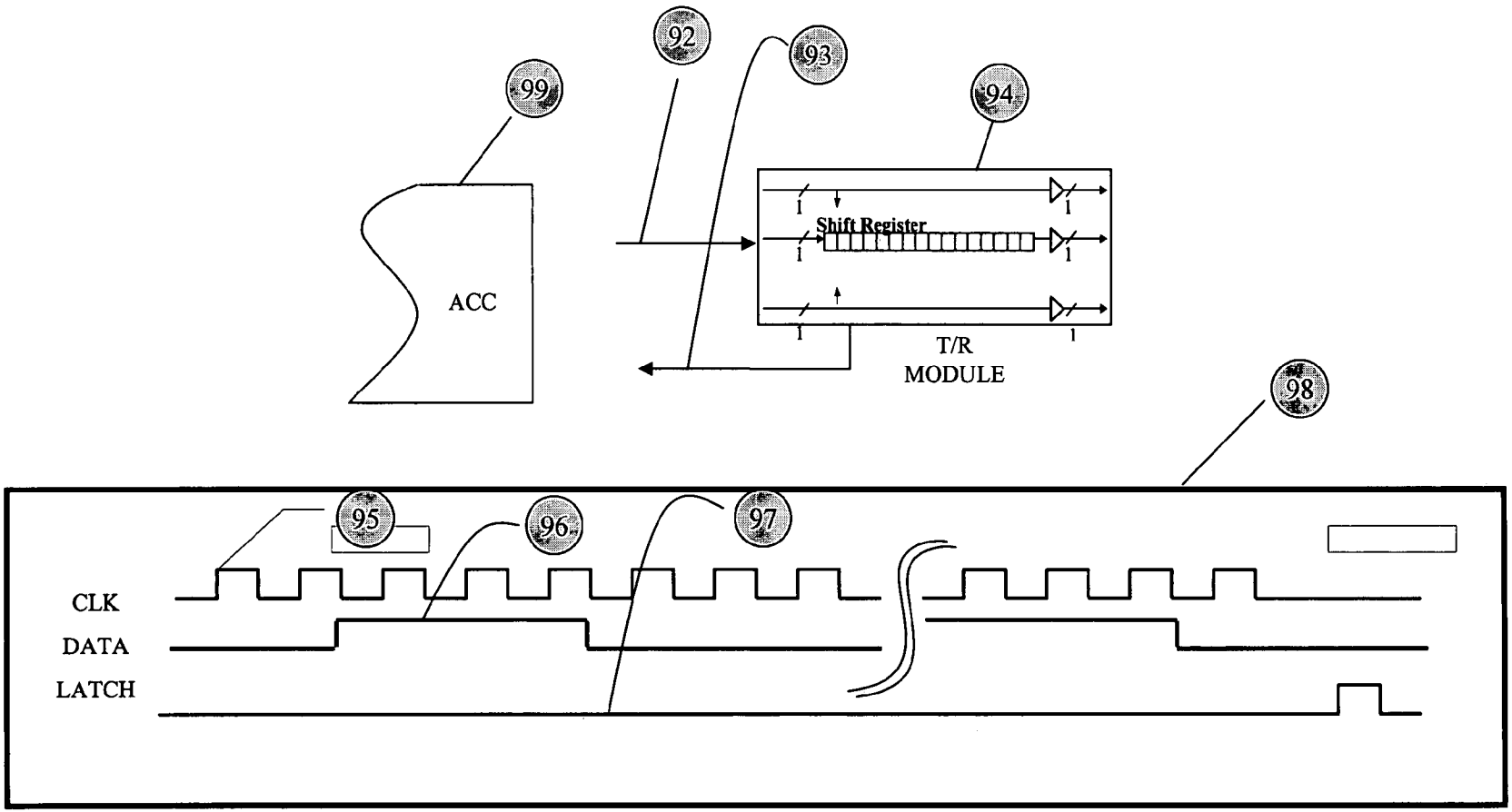
FIG. 7 is a graphical representation of the signal interface from the Antenna control computer to the T/R Module.

Again referring to FIG. 4, voltage level shifter 68, interfaces the CPLD 46 and PIC microcontroller 55 with the external synchronous signals (clock, date and enable) that are sent from the antenna control computer 99 (see FIG. 7). The commands sent from the antenna control computer 99 are TTL level signals that are converted to low voltage signals of 0/3.3 V. This chip further isolates the internal circuitry of the DC board from any external noise on the command signals.

Figure 6:
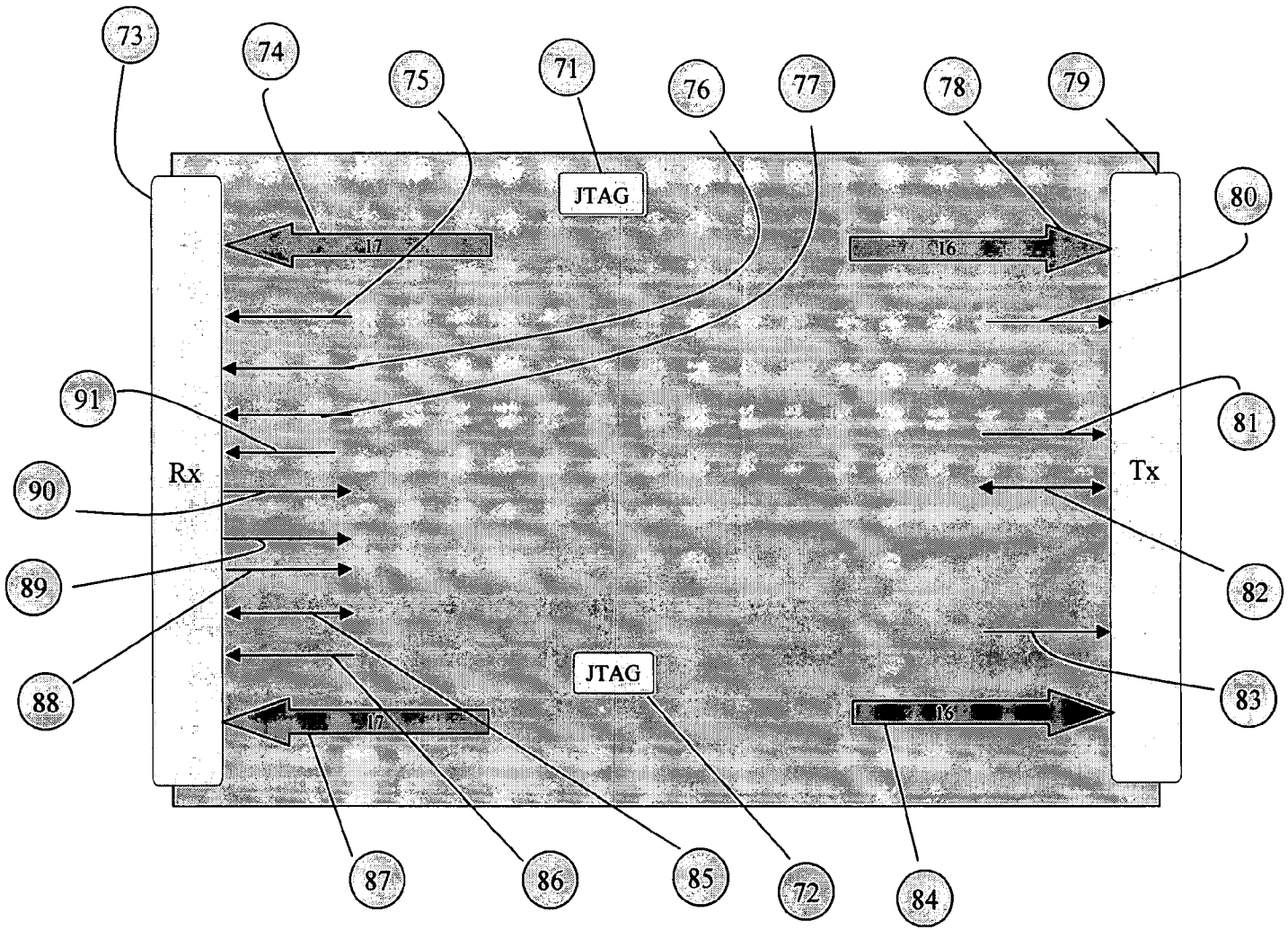
FIG. 6 is a representation of the physical layout of the DC control board.

The interconnection between the different blocks on the DC board are shown in FIG. 6. The interface block diagram shows both the top and bottom connectors 73 and 79 on the same side. The DC board is a five-layer FR4 board. The micro controller 55 (see FIG. 3) is programmed using ICD2 debugger connector 71 and the CPLD 46 (see FIG. 3) is programmed according to standard JTAG specification using the connector 72. A total of 17 control signals 74 and 87 are sent to each receiver and a total of 16 control signals 78 and 84 are sent to each transmitter. Additionally power supply lines 75 and 86 supply the low noise amplifiers on receiver 1 and receiver 2 beams, respectively. These are continuous supply lines from the power switch and are enabled at board power up.

Again referring to FIG. 6, high current lines 80, 83 supply the power amplifiers on transmitter 1 and transmitter 2, respectively. Unlike power supply lines 75 and 86, the user has the option of turning on/off these supply lines. Also unlike power supply lines 75 and 86, which share the same power switch, high current lines 80 and 83 are sourced from two separate power switches.

The three synchronous serial signals 90 from the antenna control computer are routed to both the CPLD 46 (see FIG. 3) and also the micro controller 55 (see FIG. 3). Once the CPLD 46 receives the data, on a latch high, it sends the data to the selected channel. The PIC microcontroller 55 also stores a copy of the received data. Upon request, this data along with the BIT data, 77 is sent to the antenna control computer. Lines 88 and 89 represent +5 low power and +5 high power supply lines.

Referring to FIG. 7, synchronous serial interface 92 for which the timing diagram is depicted 98, consists of clock 95, data 96 and latch 97 signals from the antenna control computer 99 to T/R modules, when it reaches the module 94, is single ended TTL at CMOS levels defined as a high level being 3.5 V minimum and a low signal being 0.4 V maximum. The maximum beam update rate is limited by the speed of the micro controller 55 on the T/R Module. This microcontroller 55 sends the module status data to the antenna control computer 99. The maximum beam update rate on the T/R module is 4 MHz. BIT information 93 is sent back from the module 94 to the antenna control computer 99.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A transmit and receive (T/R) module, having at least one receive channel and at least one transmit channel, each of said at least one receive channel and at least one transmit channel having means for selecting a polarization of opposite sense to said other channel, being responsive to control signals so as to provide means for electronic beam scanning, beam forming and radiated power when used in conjunction with a plurality of T/R modules and radiating and receiving elements in a phased-array antenna, comprising:

a radio frequency (RF) section, further comprising for each of said at least one receive channel and said at least one transmit channel a diplexed antenna port interface into which is input or output an uplink signal or a downlink signal, respectively;

a transmit signal input path;

further comprising a phase shifter for varying the phase of said uplink signal; a first switch to alternately turn said uplink signal on and off; and attenuator for varying the power level of said uplink signal; a first amplifier for preamplifying said uplink signal; a first double throw switch for setting transmit polarization of said uplink signal by selectably routing said transmit signal path through one of two power combiners, the output of said one of two power combiners being routed through one of two inputs of a 90 degree hybrid coupler; a power amplifier for amplifying a quadrature output component of said 90 degree hybrid coupler prior to being input into said diplexed antenna port interface;

a received signal output path;

further comprising a low noise amplifier which amplifies said downlink signal output from said diplexed, bidirectional antenna port interface; a 90 degree hybrid coupler which divides said downlink signal into quadrature components; a power divider for dividing each of said quadrature components; a second single pole, double throw switch for setting receive polarization by selecting either of said power divided quadrature components as receive signal outputs; a first amplifier for providing gain to said selected signal; a phase shifter for varying the phase of said selected signal so as to provide antenna receive beam steering; a second switch to turn said selected signal alternatively on or off; an attenuator for varying the power level of said selected signal; and a second amplifier for providing gain to said selected signal; and a digital section;

further comprising an interface to an antenna control computer for controlling the phase, polarization and amplitude of said received signal output path and said transmit signal input path;

a built-in-test (BIT) circuit; and a power supply circuit.

2. Digital section of claim 1, further comprising:

a complex programmable logic device (CPLD) scanning incoming synchronous signals (clock, data and enable) so as to control the phase, polarization and amplitude of said received signal output path and said transmit signal input path;

a micro controller with built in 5-channel analog to digital converter to provide built in test (BIT) response from said T/R module; and a plurality of power switches for providing stable bias to the T/R module and for switching the power to the power amplifiers on the transmit board alternately on and off.

3. T/R module of claim 2, wherein connection means to an antenna comprises six microminiature connectors (MMCX).

4. T/R module of claim 3, wherein said phase shifter further comprises eight double pole double throw (DPDT) GaAs MMIC switches so as to provide four phase shifts of 22.5, 45, 90 and 180 degrees.

5. T/R module of claim 1, wherein each of said attenuators further comprises a GaAs MMIC 5-bit digital attenuator.

6. T/R module of claim 2, wherein said CPLD further comprises:

128 macro cells;

100 inputs and outputs, operating at 3.3 volts;

16-bit shift register; and 1.8 volts core logic for low power.

7. T/R module of claim 6, wherein each of said macro cells further comprises:

a single flip flop with control circuitry.

8. T/R module of claim 2, wherein said micro controller further comprises:

at least five, 10-bit resolution analog to digital converters;

a TTL interface to the power switch for over current protection; and an operating frequency of at least 20 MHz.

9. T/R module of claim 2, wherein said plurality of power switches further comprises:

an enable input which can be used to enable/disable the power amplifiers on the transmit channels.

10. T/R module of claim 2, further comprising:

a temperature sensor with a fixed output analog voltage that is proportional to the temperature, wherein the operating range of said temperature sensor is compatible with the MIL specs.

11. Interface to antenna control computer of claim 1, further comprising an 18-pin connector through which said phase, polarization and amplitude control signals are sent.

12. Complex programmable logic device (CPLD) of claim 2, being a XLINX device.

13. Digital section of claim 2, further comprising a JTAG and ICD2 connector for programming said complex programmable logic device (CPLD) and said microcontroller, respectively.

14. Digital section of claim 13, further comprising a synchronous serial interface for routing said clock, data and latch (enable) signals from said antenna control computer to said T/R module.

15. T/R module of claim 1, further comprising means for updating an antenna beam at rates up to 4 MHz.

16. Phase shifters of claim 4, wherein said phase shift means comprises varying RF path lengths between said switches.

17. Quantity of said at least one receive channel and at least one transmit channel in claim 1, being two (2) each.

* * * * *